US011838735B2

(12) United States Patent
Zhao et al.

(10) Patent No.: US 11,838,735 B2
(45) Date of Patent: Dec. 5, 2023

(54) VOICE COIL ASSEMBLY AND LOUDSPEAKER

(71) Applicant: GOERTEK INC., Shandong (CN)

(72) Inventors: Yue Zhao, Shandong (CN); Xinglong Wang, Shandong (CN); Jianjian Wang, Shandong (CN)

(73) Assignee: GOERTEK INC., Shandong (CN)

( * ) Notice: Subject to any disclaimer, the term of this patent is extended or adjusted under 35 U.S.C. 154(b) by 0 days.

(21) Appl. No.: 17/775,905

(22) PCT Filed: Nov. 11, 2020

(86) PCT No.: PCT/CN2020/127927
§ 371 (c)(1),
(2) Date: May 11, 2022

(87) PCT Pub. No.: WO2021/093749
PCT Pub. Date: May 20, 2021

(65) Prior Publication Data

US 2022/0386033 A1 Dec. 1, 2022

(30) Foreign Application Priority Data

Nov. 11, 2019 (CN) ..... 201911093555.4

(51) Int. Cl.
*H04R 9/04* (2006.01)
*H04R 7/12* (2006.01)
(Continued)

(52) U.S. Cl.
CPC ..... *H04R 9/046* (2013.01); *H04R 7/12* (2013.01); *H04R 7/18* (2013.01); *H04R 7/26* (2013.01);
(Continued)

(58) Field of Classification Search
CPC ..... H04R 9/046; H04R 9/025; H04R 9/06; H04R 7/12; H04R 7/18; H04R 7/26; H04R 2209/041
See application file for complete search history.

(56) References Cited

U.S. PATENT DOCUMENTS

2018/0279052 A1 9/2018 Reining

FOREIGN PATENT DOCUMENTS

CN 1310576 A 8/2001
CN 202004955 U 10/2011
(Continued)

OTHER PUBLICATIONS

International Search Report from International Application No. PCT/CN2020/127927 dated Feb. 10, 2021.
(Continued)

*Primary Examiner* — Sunita Joshi
(74) *Attorney, Agent, or Firm* — Shih IP Law Group, PLLC

(57) ABSTRACT

Disclosed are a voice coil assembly and a loudspeaker, comprising a main voice coil and a connecting coil connected to the main voice coil, the main voice coil is connected to an external circuit, and comprises a first voice coil and a second voice coil, the first voice coil is formed by winding a conductive first wire with self-bonding coating, the second voice coil is formed by winding a second wire with self-bonding coating, the first voice coil and the second voice coil are positioned close to each other and bonded together, the first voice coil and the second voice coil are connected in series or in parallel, the connecting coil is formed by winding a third wire, and the density of the third wire is less than or equal to that of the first wire and the second wire.

9 Claims, 2 Drawing Sheets

(51) Int. Cl.

| | |
|---|---|
| ***H04R 7/18*** | (2006.01) |
| ***H04R 7/26*** | (2006.01) |
| ***H04R 9/02*** | (2006.01) |
| ***H04R 9/06*** | (2006.01) |

(52) U.S. Cl.
CPC ..... *H04R 9/025* (2013.01); *H04R 9/06* (2013.01); *H04R 2209/041* (2013.01)

(56) References Cited

FOREIGN PATENT DOCUMENTS

| | | | | |
|---|---|---|---|---|
| CN | 103428611 | A | | 12/2013 |
| CN | 203504745 | U | | 3/2014 |
| CN | 204993824 | U | | 1/2016 |
| CN | 105472512 | A | | 4/2016 |
| CN | 106028236 | A | | 10/2016 |
| CN | 205830008 | U | * | 12/2016 |
| CN | 206313983 | U | | 7/2017 |
| CN | 107509131 | A | | 12/2017 |
| CN | 108769878 | A | | 11/2018 |
| CN | 109936800 | A | | 6/2019 |
| CN | 209017298 | U | | 6/2019 |
| CN | 209017311 | U | | 6/2019 |
| CN | 110191402 | A | | 8/2019 |
| CN | 209562791 | U | | 10/2019 |
| CN | 110830890 | A | | 2/2020 |
| DE | 102016114596 | A1 | | 2/2018 |
| EP | 2667637 | A2 | * | 11/2013 ..... H04R 1/005 |
| EP | 2876897 | A4 | | 1/2016 |
| JP | 2007005845 | A | | 1/2007 |

OTHER PUBLICATIONS

Page 87-89 of "Practical Loudspeaker Manual" written by Wang, Yizhen published on Apr. 30, 2003.

* cited by examiner

VOICE COIL ASSEMBLY AND LOUDSPEAKER

TECHNICAL FIELD

The present disclosure relates to the technical field of acousto-electric device, in particular to a voice coil assembly and a loudspeaker.

BACKGROUND ART

Micro-loudspeakers are widely used in portable electronic devices such as mobile phones, notebook computers, and hearing aids. With the rapid development of these portable electronic devices, the requirements for the micro electro-acoustic devices used in them are getting higher and higher.

Among them, a voice coil is an important part of the micro-loudspeaker. In order to obtain a larger amplitude for the loudspeaker, a distance from the dome to the washer needs to be increased. However, since the voice coil on the side of the dome is far from the magnetic gap, the BL value decreases, and the increase in sensitivity of the voice coil decreases. In order to ensure the sensitivity of the core and the rigid connection between the voice coil and the diaphragm, the height of the voice coil needs to be continuously increased, resulting in the continuous increase of the weight of the voice coil and the decrease of the sensitivity of the voice coil. In addition, for some loudspeakers, an unconnected coil is usually used (that is, the voice coil is not wound on the voice coil bobbin), and the unconnected coil is generally formed by integrally wounding a wire. As such, as an integrally wound component, the unconnected coil is not conducive to the monitoring and control of the voice coil, thereby not conducive to improving the acoustic performance of the loudspeaker.

SUMMARY

A main object of the present disclosure is to provide a voice coil assembly and a loudspeaker, aiming at solving the technical problem of how to improve the acoustic performance of the loudspeaker.

In order to achieve the above object, the present disclosure provides a voice coil assembly, including a main voice coil and a connecting coil connected to the main voice coil, and the main voice coil is connected to an external circuit, wherein the main voice coil includes a first voice coil and a second voice coil, wherein the first voice coil is formed by winding a first wire, and the first wire is a conductive wire with a self-bonding coating, wherein the second voice coil is formed by winding a second wire, and the second wire is a conductive wire with a self-bonding coating, the first voice coil and the second voice coil are positioned close to each other and bonded together by the self-bonding coatings of the first wire and the second wire, and the first voice coil and the second voice coil are connected in series or in parallel, wherein the connecting coil is formed by winding a third wire, the third wire is a wire with a self-bonding coating, the density of the third wire is less than or equal to that of the first wire and the second wire, and wherein the connecting coil and the first voice coil are positioned close to each other and bonded together by the self-bonding coatings of the third wire and the first wire.

Optionally, the third wire is a conductive wire or an insulating wire.

Optionally, the height of the main voice coil is greater than the height of the connecting coil.

Optionally, the first wire and the second wire are copper wires with the self-bonding coatings, or copper-clad aluminum wires with the self-bonding coatings, and the third wire is a copper-clad aluminum wire with the self-bonding coating or an aluminum wire with the self-bonding coating.

Optionally, the wire diameters of the first wire and the second wire are the same, and the wire diameter of the third wire is smaller than the wire diameters of the first wire and the second wire.

Optionally, the thickness of the connecting coil is smaller than the thickness of the main voice coil.

In an embodiment, the connecting coil is located at the inner side of the top surface of the first voice coil, and an accommodation space is formed between the outer surface of the connecting coil and the outer side of the top surface of the first voice coil.

In an embodiment, alternatively, the connecting coil is located at the outer side of the top surface of the first voice coil, and an accommodation space is formed between the inner surface of the connecting coil and the inner side of the top surface of the first voice coil.

In an embodiment, alternatively, the connecting coil is located at a center portion of the top surface of the first voice coil, and an accommodation space is formed between the outer surface of the connecting coil and the outer side of the top surface of the first voice coil and between the inner surface of the connecting coil and the inner side of the top surface of the first voice coil.

Optionally, the connecting coil is located at the inner side of the top surface of the first voice coil, the top surface of the first voice coil is provided with a groove correspondingly opened at the inner side and the top surface of the first voice coil, and the bottom surface and an outer surface of the lower end of the connecting coil are bonded with the bottom surface and side surface of the groove of the first voice coil.

In an embodiment, alternatively, the connecting coil is located at the outer side of the top surface of the first voice coil, the top surface of the first voice coil is provided with a groove correspondingly opened at the outer side and the top surface of the first voice coil, and the bottom surface and an inner surface of the lower end of the connecting coil are bonded with the bottom surface and side surface of the groove of the first voice coil.

Optionally, the first wire, the second wire, and the third wire have a circular cross section or a rectangular cross section.

A loudspeaker, including a vibration system and a magnetic circuit system, the vibration system includes a diaphragm and a voice coil assembly, wherein the voice coil assembly is the above-mentioned voice coil assembly, a top surface of the connecting coil is connected to the diaphragm, and the main voice coil is provided in a magnetic gap of the magnetic circuit system.

Optionally, the vibration system further includes a damper, and the damper includes an inner fixing portion, an outer fixing portion, and a deformation portion connecting the inner fixing portion and the outer fixing portion.

In an embodiment, the diaphragm includes a center portion, a folded ring portion and an edge portion from inside to outside thereof, the inner fixing portion is coupled to the center portion, and the outer fixing portion is coupled to the edge portion.

In an embodiment, the top surface of the connecting coil is coupled to the inner fixing portion.

In the voice coil assembly according to the present disclosure, the connecting coil is bonded on the top of the main voice coil, so that most of the main voice coil is placed in the dense area of magnetic induction lines, the BL value may be increased, and the driving force for vibrating the main voice coil up and down may be balanced.

The main voice coil is connect with the external circuit, while the connecting coil is not connected with the external circuit, the connecting coil can only transfer a small amount of heat of the main voice coil or does not transfer the heat of the main voice coil to the diaphragm or the damper to protect the diaphragm or the damper from being damaged during loudspeaker operation; at the same time, the connecting coil can also have good heat dissipation function and reduce the temperature of the main voice coil;

The connecting coil, the first voice coil and the second voice coil are separately connected and arranged, the connecting coil can place the first voice coil and the second voice coil in the magnetic gap, and when the two voice coils are connected in series, the vibration position of the voice coil assembly in the magnetic field can be calculated in real time so as to correct the position of the voice coil assembly, so that the vibration of the voice coil assembly in the magnetic field can be more stable, and thus the vibration of the diaphragm can be more stable, thereby effectively improving the overall acoustics performance of the loudspeaker.

When two voice coils are connected in parallel, in the case of the same resistance value, the thickness of the voice coils can be thinner, the magnetic gap can be narrowed, and the BL value can be higher, so as to improve the sensitivity of the vibration system and the sound performance of sound producing unit. In addition, the two voice coils have four leads, have more symmetrical reaction force to the vibration system during vibration, thereby greatly decreasing asymmetrical vibration of product, improving distortion, and improving sound quality.

The density of the third wire selected for the connecting coil is smaller than the density of the first wire of the first voice coil and the second wire of the second voice coil, which can effectively reduce the weight of the voice coil assembly and improve the sensitivity of the vibration system.

BRIEF DESCRIPTION OF THE DRAWINGS

The embodiments of the present disclosure will be described below with reference to the accompanying drawings. It should be understood that, the described embodiments are only examples according to the present disclosure, and the present disclosure includes all of the modified embodiments thereof.

REFERENCE NUMERALS

10: connecting coil; 20: main voice coil; 21: first voice coil; 22: second voice coil; 3: central washer; 4: central magnetic circuit; 5: side magnetic circuit; 6: diaphragm.

The object, functional features and advantages achieved by the present disclosure will be further described with reference to the accompanying drawings in conjunction with the embodiments.

DETAILED DESCRIPTION OF THE EMBODIMENTS

The technical solutions in the embodiments of the present disclosure will be clearly and completely described below with reference to the accompanying drawings. It should be understood that, the described embodiments are only examples according to the present disclosure, and the present disclosure includes all of the modified embodiments thereof.

It should be noted that if there are directional indications (such as up, down, left, right, front, rear, etc.) involved in the embodiments of the present disclosure, the directional indications are only provided to explain the relative position relationship and motion between components in a specific attitude (as shown in the accompanying drawings), and if the specific attitude changes, the directional indication also changes accordingly.

In addition, if there are descriptions involving "first", "second", etc. in the embodiments of the present disclosure, they are only used for description, and should not be construed as indicating or implying its relative importance or implicitly indicating the number of indicated technical features. Therefore, a feature defined with "first" and "second" may explicitly or implicitly include at least one of those elements. In addition, the meaning of "and/or" in the full text is to include three parallel schemes. Taking "A and/or B" as an example, it includes a scheme A, a scheme B, or a scheme A and B. In addition, the technical solutions between various embodiments can be combined with each other, but must be based on the realization by those of ordinary skill in the art. When the combination of technical solutions is contradictory or impossible, it should be considered that the combination of such technical solutions does not exist and is not within the protection scope of the present disclosure.

The present disclosure provides a voice coil assembly.

It will be appreciated that the voice coil assembly according to the present disclosure may be used in a loudspeaker as a part of a vibration system of the loudspeaker. Specifically, as shown in FIG. 1, the loudspeaker generally includes a vibration system and a magnetic circuit system, wherein the loudspeaker has various structural forms, and the following is only illustrated as an example, which is not intended to limit the application scope of the voice coil assembly according to the present disclosure.

Figure 1:
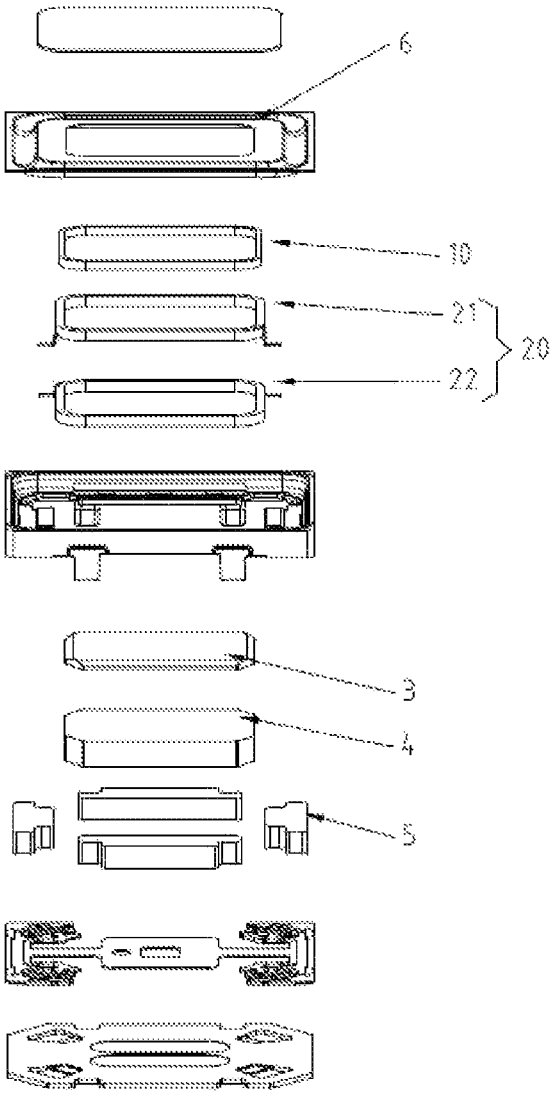
FIG. 1 is a schematic view illustrating a loudspeaker according to the present disclosure.

Optionally, as shown in FIG. 1, the magnetic circuit system includes a central magnetic circuit 4 and side magnetic circuits 5. The central magnetic circuit 4 generally includes a central magnet and a central washer 3 disposed on the central magnet, the side magnetic circuits 5 may include a side magnet and a washer disposed on the side magnet, wherein a magnetic circuit gap (not shown) is formed between the center magnetic circuit 4 and the side magnetic circuits 5. The vibration system includes a diaphragm 6 and a voice coil assembly. One end of the voice coil assembly is connected to the diaphragm 6, and the other end thereof is provided in the magnetic circuit gap.

More specifically, the voice coil assembly includes a main voice coil 20 and a connecting coil 10 connected to the main voice coil 20. The main voice coil 20 is connected to an external circuit, and includes a first voice coil 21 and a second voice coil 22. The first voice coil 21 is formed by winding a first wire, and the first wire is a conductive wire with a self-bonding coating. The second voice coil 22 is formed by winding a second wire, and the second wire is a conductive wire with a self-bonding coating. The first voice coil 21 and the second voice coil 22 are positioned close to each other and bonded together by the self-bonding coatings of the first wire and the second wire, and are connected in series or in parallel.

In addition, the connecting coil 10 is formed by winding a third wire, and the third wire is a wire with a self-bonding coating. In a specifical embodiment, the density of the third wire is less than or equal to that of the first wire and the second wire;

In addition, the connecting coil 10 and the first voice coil 21 are positioned close to each other and bonded together by the self-bonding coatings of the third wire and the first wire.

The connecting coil 10 and the first voice coil 21 are positioned close to each other and bonded together by the self-bonding coatings of the third wire and the first wire. In a specifical embodiment, the first voice coil 21 and the second voice coil 22 are positioned close to each other and bonded together by the self-bonding coatings of the first wire and the second wire. The bonding forces between the connecting coil 10 and the first voice coil 21 and between the first voice coil 21 and the second voice coil 22 are high, so that the connection strength between the connecting coil 10 and the first voice coil 21 and between the first voice coil 21 and the second voice coil 22 may be improved, while the temperature resistance may also be improved.

Further, it is also possible to avoid applying an adhesive layer between the connecting coil 10 and the first voice coil 21 and between the first voice coil 21 and the second voice coil 22, and thus a decrease of the sensitivity of the loudspeaker due to the adhesive layer can be avoided, so as to improve the sensitivity of the loudspeaker.

The first voice coil 21 is formed by winding a first wire, the second voice coil 22 is formed by winding a second wire, and the connecting coil 10 is formed by winding a third wire. The density of the third wire is less than or equal to those of the first wire and the second wire. It can be known that, the density of the materials selected for the connecting coil 10 is less than or equal to that of the main voice coil 20 can effectively reduce the weight of the voice coil assembly and improve the sensitivity of the vibration system.

In a specific embodiment, the first voice coil 21 and the second voice coil 22 may be connected in series or in parallel, which can improve the acoustic performance of the loudspeaker. Each of these cases are separately discussed below.

In some embodiments, the first voice coil 21 and the second voice coil 22 are connected in series.

It can be known that, when the first voice coil 21 and the second voice coil 22 are connected in series, the leading-out terminal of the first voice coil 21 is electrically connected to the leading-in terminal of the second voice coil 22, or the leading-in terminal of the first voice coil 21 is electrically connected to the leading-out terminal of the second voice coil 22, so that the first voice coil 21 and the second voice coil 22 are connected in series.

As such, the position of the voice coil assembly in the magnetic circuit gap is modeled according to the electromotive force difference between the first voice coil 21 and the second voice coil 22 during the operation of the voice coil assembly, so that the position of the voice coil assembly can be calculated in real time, and thus the vibration system of the loudspeaker can be optimized in real time to improve the acoustic performance of the loudspeaker.

Specifically, when two voice coils are connected in series, since the positions of the first voice coil 21 and the second voice coil 22 in the magnetic field of the magnetic circuit gap are different, the magnetic induction intensity passing through the first voice coil 21 and the second voice coil 22 is different, so that the induced electromotive force generated by the first voice coil 21 and the second voice coil 22 is also different. By detecting the voltage difference at the connection between the first voice coil 21 and the second voice coil 22, the relative position of the first voice coil 21 and the second voice coil 22 in the magnetic field, that is, the vibration position of the entire voice coil assembly in the magnetic field, can be calculated in real time.

If the voice coil assembly deviates from the preset position during vibration, the positions of the first voice coil 21 and the second voice coil 22 may be changed, and at this time, the induced electromotive force generated by the first voice coil 21 and the second voice coil 22 may be changed. That is, the voltage difference at the connection between the first voice coil 21 and the second voice coil 22 may be changed. By detecting the change of the voltage difference, the overall offset of the voice coil assembly can be calculated, so that the voice coil assembly can be returned to the preset position by inputting compensation current from the external circuit, and the position of the voice coil assembly can be corrected, so as to improve the vibration stability and symmetry of the voice coil assembly in the magnetic field, thereby effectively improving the overall acoustic performance of the loudspeaker.

In some embodiments, the first voice coil 21 and the second voice coil 22 are connected in parallel.

It can be known that, when the two voice coils are connected in parallel, in the case of the same resistance value, the thickness of the voice coils can be thinner, the magnetic gap can be narrowed, and the BL value can be higher, so as to improve the sensitivity of the vibration system and the sound performance of sound producing unit.

In the embodiments, the leading-in terminal and leading-out terminal of the first voice coil 21 and the leading-in terminal and leading-out terminal of the second voice coil 22 are connected to the external circuit respectively. At this time, by controlling the arrangement of the leading-in terminals and leading-out terminals of the first voice coil 21 and second voice coil 22, the reaction force of the four leads to the vibration system can be relatively symmetrical when the voice coil assembly vibrates, thereby greatly decreasing asymmetrical vibration of the product, improving distortion, and improving sound quality.

In an embodiment, the third wire is a conductive wire or an insulating wire, there is no electrical connection between the connecting coil 10 and the main voice coil 20 and not connected with an external circuit, and the connecting coil 10 only plays a role of supporting, so that the main voice coil 20 may be wholly positioned in the magnetic gap, which can increase the BL value. At the same time, the heat generated by the main voice coil 20 cannot be directly transferred to the diaphragm 6 or the damper, which can effectively prevent the diaphragm 6 or the damper from being damaged due to excess temperature.

In an embodiment, the height of the main voice coil 20 is greater than the height of the connecting coil 10, which can reduce the weight of the voice coil assembly to a certain extent and improve the sensitivity of the voice coil.

In an embodiment, when the first wire and the second wire are copper wires with self-bonding coatings, or copper-clad aluminum wires with self-bonding coatings, the third wire is a copper-clad aluminum wire or an aluminum wire with a self-bonding coating. It can be known that, due to the selection of the materials of the first wire, the second wire and the third wire, the weight of the third wire can be reduced, and thus reduce the overall weight of the voice coil assembly. Meanwhile, when the first wire, the second wire and the third wire are all copper-clad aluminum wires, the percentage of copper of the third wire can be smaller than that of the first wire and the second wire, thereby reducing the weight of the third wire as much as possible, to improve the sensitivity of the voice coil.

In an embodiment, the wire diameters of the first wire and the second wire are the same, and the wire diameter of the third wire is smaller than the wire diameters of the first wire and the second wire. This arrangement minimizes the height and weight of the connecting coil and reduces driving force for the up and down movement of the main voice coil 20.

In an embodiment, the thickness of the connecting coil 10 is smaller than the thickness of the main voice coil 20, the connecting coil 10 is located at the inner side of the top portion of the first voice coil 21, and an accommodation space is formed between the outer surface of the connecting coil 10 and the outer side of the top surface of the first voice coil 21. Alternatively, the connecting coil 10 is located at the outer side of the top surface of the first voice coil 21, and an accommodation space is formed between the inner surface of the connecting coil 10 and the inner side of the top surface of the first voice coil 21. Alternatively, the connecting coil 10 is located at a center portion of the top surface of the first voice coil 21, and an accommodation space is formed between the outer surface of the connecting coil 10 and the outer side of the top surface of the first voice coil 21 and between the inner surface of the connecting coil 10 and the inner side of the top surface of the first voice coil 21. The upper surface area of the top surface of the first voice coil 21 is larger than the lower surface area of the bottom of the connecting coil 10 can increase the connection strength between the bottom of the connecting coil 10 and the top surface of the first voice coil 21, so that the bonding between the connecting coil 10 and the first voice coil 21 is firmer.

In an embodiment, the connecting coil 10 is located at the inner side of the top surface of the first voice coil 21, the top surface of the first voice coil 21 is provided with a groove correspondingly opened at the inner side and the top surface of the first voice coil 21, and the bottom surface and an outer surface of the lower end of the connecting coil 10 are bonded with the bottom surface and side surface of the groove of the first voice coil 21. The bonding position of the connecting coil 10 and the first voice coil 21 is not limited to the bottom surface of the connecting coil 10 and the top surface of the first voice coil 21, an outer surface at the bottom of the connecting coil 10 and the inner surface of the first voice coil 21 can also be bonded to increase the bonding strength of the connecting coil 10 and the first voice coil 21.

Alternatively, the connecting coil 10 is located at the outer side of the top surface of the first voice coil 21, the top surface of the first voice coil 21 is provided with a groove correspondingly opened at the inner side and the top surface of the first voice coil 21, and the bottom surface and an inner surface of the lower end of the connecting coil 10 are bonded with the bottom surface and side surface of the groove of the first voice coil 21, to increase the bonding strength of the connecting coil 10 and the first voice coil 21.

In an embodiment, the first wire, the second wire, and the third wire have a circular cross section or a rectangular cross section. It should be understood that the shape of the connecting coil 10, the first voice coil 21 and the second voice coil 22 can be freely selected and combined. In other embodiments, the first wire, the second wire, and the third wire are not limited to the exemplified shapes, and the first wire, the second wire, and the third wire can also be in other shapes, which will not be repeatedly described herein.

Figure 2:
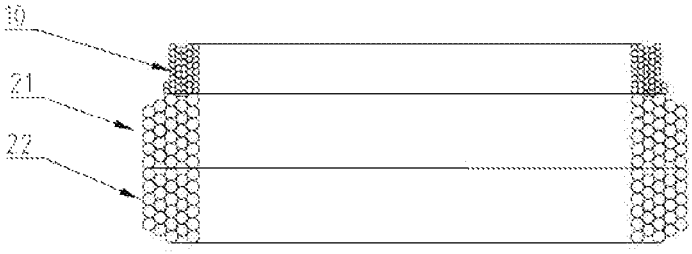
FIG. 2 is a schematic view illustrating a connecting coil, a first voice coil and a second voice coil having a circular cross section according to the present disclosure.

In some embodiments, as shown in FIG. 2, the connecting coil 10 has a circular cross section, the first voice coil 21 and the second voice coil 22 have a circular cross section, which is convenient for the connecting coil 10, the first voice coil 21, and the second voice coil 22 to be wound on the same winding tooling.

Figure 3:
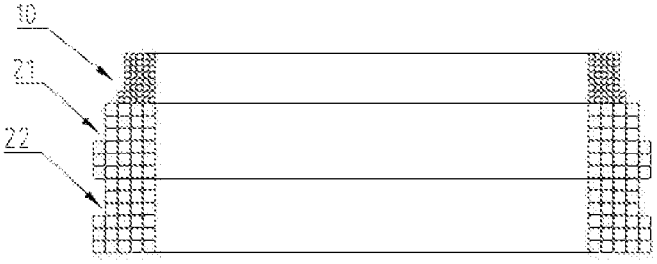
FIG. 3 is a schematic view illustrating a connecting coil having a circular cross section and a first voice coil and a second voice coil having a rectangular cross section according to the present disclosure.

In some embodiments, as shown in FIG. 3, the connecting coil 10 has a circular cross section, the first voice coil 21 and the second voice coil 22 have a rectangular cross section, which can increase the contact area of the first voice coil 21 and the second voice coil 22 and improves the connection strength between the first voice coil 21 and the second voice coil 22.

Figure 4:
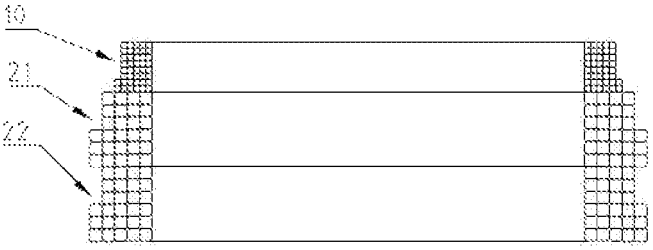
FIG. 4 is a schematic view illustrating a connecting coil, a first voice coil and a second voice coil having a rectangular cross section according to the present disclosure.

In some embodiments, as shown in FIG. 4, the connecting coil 10 has a rectangular cross section, the first voice coil 21 and the second voice coil 22 have a rectangular cross section, which can increase the contact area of the connecting coil 10 and the first voice coil 21 as well as the first voice coil 21 and the second voice coil 22, and when the connecting coil 10, the first voice coil 21, and the second voice coil 22 have a rectangular cross section, the connection area between the connecting coil 10 and the first voice coil 21 and the connection area between the first voice coil 21 and the second voice coil 22 are increased so that the connection strength between the connecting coil 10 and the first voice coil 21 and the connection strength between the first voice coil 21 and the second voice coil 22 are improved, thereby improving the overall acoustic performance of the loudspeaker.

On another aspect, the present disclosure provides a loudspeaker, including a vibration system and a magnetic circuit system, the vibration system includes a diaphragm 6 and a voice coil assembly, wherein, the voice coil assembly is the above-mentioned voice coil assembly, the top surface of the connecting coil 10 is connected to the diaphragm, and the main voice coil 20 is provided in the magnetic gap of the magnetic circuit system. Since the loudspeaker according to the present disclosure includes the voice coil assembly as disclosed above, it has all the beneficial achieved by the voice coil assembly, which will not be repeatedly described herein.

During the working process of the loudspeaker, the voice coil assembly is energized, the energized voice coil assembly is subjected to force in the magnetic field to vibrate, and the vibrating voice coil assembly will drive the diaphragm 6 to vibrate, so that the diaphragm 6 drives the air to make sound.

In another embodiment, the vibration system further includes a damper, the damper includes an inner fixing portion, an outer fixing portion, and a deformation portion connecting the inner fixing portion and the outer fixing portion. The diaphragm 6 includes a center portion, a folded ring portion and an edge portion from inside to outside thereof, the inner fixing portion is coupled to the center portion, and the outer fixing portion is coupled to the edge portion. The top surface of the connecting coil 10 is coupled to the inner fixing portion. The damper is used for stabilizing the vibration state of the voice coil assembly and plays role of center alignment, so as to mitigate asymmetrical vibration phenomenon of the voice coil assembly, improve distortion, and improve sound quality.

The above are only preferred embodiments of the present disclosure, and are not intended to limit the scope of the invention. In addition, the equivalent structure transformation made by using the contents of the description and drawings of the present disclosure, or the direct/indirect applications in other relevant technical fields, are included within the protection scope of the present disclosure.

What is claimed is:

1. A voice coil assembly, comprising a main voice coil and a connecting coil connected to the main voice coil, wherein the main voice coil is connected to an external circuit, wherein the main voice coil comprises a first voice coil and a second voice coil, wherein the first voice coil is formed by winding a first wire, and the first wire is a conductive wire with a self-bonding coating, wherein the second voice coil is formed by winding a second wire, and the second wire is a conductive wire with a self-bonding coating, the first voice coil and the second voice coil are positioned close to each other and bonded together by the self-bonding coatings of the first wire and the second wire, and the first voice coil and the second voice coil are connected in series or in parallel, wherein the connecting coil is formed by winding a third wire, the third wire is a wire with a self-bonding coating, and the density of the third wire is less than or equal to that of the first wire and the second wire, and wherein the connecting coil and the first voice coil are positioned close to each other and bonded together by the self-bonding coatings of the third wire and the first wire, wherein a height of the main voice coil is greater than a height of the connecting coil.

2. The voice coil assembly of claim 1, wherein the third wire is a conductive wire or an insulating wire.

3. The voice coil assembly of claim 1, wherein the first wire and the second wire are copper wires with the self-bonding coatings, or copper-clad aluminum wires with the self-bonding coatings, and the third wire is a copper-clad aluminum wire with the self-bonding coating or an aluminum wire with the self-bonding coating.

4. The voice coil assembly of claim 1, wherein wire diameters of the first wire and the second wire are the same, and a wire diameter of the third wire is smaller than the wire diameters of the first wire and the second wire.

5. The voice coil assembly of claim 1, wherein a thickness of the connecting coil is smaller than a thickness of the main voice coil, and wherein the connecting coil is located at an inner side of a top surface of the first voice coil, and an accommodation space is formed between an outer surface of the connecting coil and an outer side of the top surface of the first voice coil, or wherein the connecting coil is located at the outer side of the top surface of the first voice coil, and an accommodation space is formed between an inner surface of the connecting coil and the inner side of the top surface of the first voice coil, or wherein the connecting coil is located at a center portion of the top surface of the first voice coil, and an accommodation space is formed between the outer surface of the connecting coil and the outer side of the top surface of the first voice coil and between the inner surface of the connecting coil and the inner side of the top surface of the first voice coil.

6. The voice coil assembly of claim 5, wherein the connecting coil is located at the inner side of the top surface of the first voice coil, the top surface of the first voice coil is provided with a groove correspondingly opened at the inner side and the top surface of the first voice coil, and a bottom surface and an outer surface of the lower end of the connecting coil are bonded with a bottom surface and a side surface of the groove of the first voice coil, or the connecting coil is located at the outer side of the top surface of the first voice coil, the top surface of the first voice coil is provided with a groove correspondingly opened at the outer side and the top surface of the first voice coil, and the bottom surface and an inner surface of the lower end of the connecting coil are bonded with the bottom surface and side surface of the groove of the first voice coil.

7. The voice coil assembly of claim 1, wherein the first wire, the second wire, and the third wire have a circular cross section or a rectangular cross section.

8. A loudspeaker, comprising a vibration system and a magnetic circuit system, the vibration system comprises a diaphragm and a voice coil assembly, wherein the voice coil assembly is the voice coil assembly of claim 1, a top surface of the connecting coil is connected to the diaphragm, and the main voice coil is provided in a magnetic gap of the magnetic circuit system.

9. The loudspeaker of claim 8, wherein the vibration system further comprises a damper, and the damper comprises an inner fixing portion, an outer fixing portion, and a deformation portion connecting the inner fixing portion and the outer fixing portion, wherein the diaphragm comprises a center portion, a folded ring portion and an edge portion from inside to outside thereof, the inner fixing portion is coupled to the center portion, and the outer fixing portion is coupled to the edge portion, and wherein the top surface of the connecting coil is coupled to the inner fixing portion.

* * * * *